United States Patent [19]

Oswald et al.

[11] Patent Number: 4,970,535

[45] Date of Patent: Nov. 13, 1990

[54] INK JET PRINT HEAD FACE CLEANER

[75] Inventors: James C. Oswald, Beaverton; Jeffrey J. Anderson; Ted E. Deur, both of Portland, all of Oreg.

[73] Assignee: Tektronix, Inc., Beaverton, Oreg.

[21] Appl. No.: 442,446

[22] Filed: Nov. 27, 1989

Related U.S. Application Data

[63] Continuation of Ser. No. 249,066, Sep. 26, 1988, abandoned.

[51] Int. Cl.[5] ..... B41J 2/165

[52] U.S. Cl. ..... 346/140 R

[58] Field of Search ..... 346/140

[56] References Cited

U.S. PATENT DOCUMENTS

| | | | |
|---|---|---|---|
| 4,106,032 | 8/1978 | Miura et al. | 346/140 |
| 4,223,324 | 9/1980 | Yamamori | 346/140 |
| 4,364,065 | 12/1982 | Yamamori | 346/140 |
| 4,540,997 | 9/1985 | Biggs | 346/140 |
| 4,598,303 | 7/1986 | Peekema et al. | 346/140 |
| 4,609,925 | 9/1986 | Nozo | 346/140 X |
| 4,727,378 | 2/1988 | Le et al. | 346/140 X |
| 4,829,318 | 5/1989 | Racicot et al. . | |
| 4,908,636 | 3/1990 | Saito | 346/140 |

FOREIGN PATENT DOCUMENTS

| | | |
|---|---|---|
| 3019768 | 12/1981 | Fed. Rep. of Germany . |
| 3719704A1 | 12/1987 | Fed. Rep. of Germany . |
| 133335 | 10/1979 | Japan . |
| 173670 | 10/1983 | Japan . |
| 0193857 | 8/1986 | Japan . |
| 0077944 | 4/1987 | Japan . |
| 0113561 | 5/1987 | Japan . |
| 218139 | 9/1987 | Japan . |
| 62-136165 | 12/1987 | Japan . |
| 0092459 | 4/1988 | Japan . |
| 2202800 | 10/1988 | United Kingdom . |

OTHER PUBLICATIONS

"TEK Service Manual-4692 Color Graphics Copier", Tektronix, Inc. Mar. 1986, pp. 3-69 to 3-73, 4-8, 4-9, 6-15 to 6-19.

Mitchell et al; Start-Stop Technique for Ink Jet Systems; IBM TDB vol. 20, No. 1, Jun. 1977, pp. 447-448.

*Primary Examiner*—Joseph W. Hartary

*Attorney, Agent, or Firm*—John D. Winkelman; Edward B. Anderson

[57] ABSTRACT

An ink jet print head face cleaner provides a controlled air passageway through an enclosure formed against the print face. Air is directed through an inlet into a cavity in a body. The body has a face with an opening into the cavity. This face is sealingly placeable against the print face. The cavity has a limited size so that air is directed without interruption through the cavity past the ink jet apertures, and out an outlet. The cleaner body is coupled resiliently to a platform to allow positioning of the body and print faces flush with each other. A vacuum source is preferably attached to the outlet to create a subatmospheric pressure in the cavity to further seal the two faces together. A collection chamber and removable drawer are positioned below the outlet to facilitate disposing of removed ink.

3 Claims, 2 Drawing Sheets

INK JET PRINT HEAD FACE CLEANER

This is a continuation of application Ser. No. 7/249,066 filed Sept, 26, 1989, and now abandoned.

FIELD OF THE INVENTION

This invention pertains to an apparatus and method for cleaning a printer print head, and in particular for cleaning of the aperture of an ink jet print head.

BACKGROUND AND SUMMARY OF THE INVENTION

In one basic type of ink jet head, ink drops are produced on demand. Exemplary drop-on-demand ink jet heads are illustrated in U.S. Pat. No. 4,106,032 issued to Miura et al. and U.S. Pat. No. 4,727,378 issued to Le et al. These ink jet heads produce an ink drop at an ink-drop forming aperture. The ink drop is propelled through an air chamber toward a main external aperture of the ink jet head. Air under pressure is delivered to the air chamber and entrains the drop of ink in a generally coaxial air stream as the ink drop travels through the air chamber.

During printing, drops of ink tend to collect in and around the ink jet apertures. When the ink does build up, it can prevent drop ejection, or cause improper ink drop trajectory and nonuniformity in ink drop size. It therefore becomes imperative that the aperture area be cleansed of excess ink periodically in order to maintain a consistently clean aperture during printing.

A similar ink jet head is described in U.S. Pat. No. 4,598,303 issued to Peekema et al. wherein the tendency of ink to collect around the ink jet orifice is maintained in order to standardize drop size and trajectory. These types of heads are purged by flooding the air chamber with ink to remove contaminants and air bubbles from the ink chamber and system. The unwanted ink is then expelled from the air chamber into a waste reservoir using the air pressure system. Such purging is disclosed in the Le et al. patent as well as in a service manual for a color graphics copier having model number 4692 made by Tektronix, Inc. of Beaverton, Oreg.

Apparatus has also been designed for cleaning the external face of the print head around the outer orifice. For instance physical wipers, such as squeegees and cloth wipes are moved across or blotted against the face. It is possible for such apparatus to leave some part of the cleaner substance in the aperture.

One conventional external type of cleaner is described in German Patent Application No. DE 319704 Al based on a prior Japanese Patent Application No. JP P 136165/86. This cleaner provides an enlarged cavity placeable against the face of a print head adjacent the ink jet apertures. Gas is directed at the aperture with an absorbent material disposed in the cavity and positioned below the aperture for catching ink blown down from around the aperture.

This device doesn't necessarily provide a well defined flow past the aperture for several reasons. Firstly, a seal is not developed between the cavity and the aperture face, so that the gas and ink carried by the gas can travel through the space between the print head and the body forming the cavity. Secondly, since a control volume for the impinging air stream from the air jet nozzle is not completely defined by solid boundaries, the air flow will be diverted in all directions when the air stream impinges upon the ink jet head. Thus, the gas flow is uncontrolled and tends to be dispersed. This dispersion creates inconsistency in the effectiveness of the fluid stream to carry the ink from the aperture.

The present invention provides an external ink jet print head cleaner that maintains controlled fluid flow into the cleaning region, around an ink jet aperture and out of that region without contacting the aperture region with a solid substance. The term fluid as used herein refers to both liquid and gas. In particular, a continuous well-defined passageway is provided that directs a fluid smoothly past the aperture so that the pressure, mass flow and directionality of the fluid is controlled in the vicinity of the aperture, thereby assuring effective removal of the ink drops in the area of the aperture and complete removal of ink from the print head.

This is provided by a body having a first face placeable against the print head face. This first face has an opening sized to surround the ink jet aperture when the first face is placed against the print head face. Means are provided in the body which define a cavity extending along the opening and having an inlet disposed adjacent to one edge of the opening. An outlet is disposed adjacent to a generally oppositely disposed edge of the opening. The cavity preferably has a depth away from the opening less than the length of the opening between the inlet and outlet. Finally, means are provided for directing a volume of a fluid through the inlet into the cavity and out the outlet.

The present invention also provides a method of cleaning the aperture disposed in the face of an ink jet print head. This method includes enclosing the aperture of the print head with a cavity formed in a body with a first face having an opening facing the print head face, an inlet disposed adjacent to one edge of the opening, and an outlet disposed adjacent to a generally oppositely disposed edge of the opening. A fluid supply is directed through the inlet and cavity at an angle that is substantially tangential to the aperture, and out the outlet. thereby carrying ink disposed around the apertures out through the outlet.

It can be seen that the present invention provides a simple, effective ink jet aperture cleaner. The fluid directed substantially tangentially past the aperture is maintained in a controlled fashion in a substantially unidirectional flow by a reduced cavity forming an enclosure around the apertures. These and other features and advantages of the present invention will become apparent from a reading of the following detailed description of the preferred embodiment in conjunction with the accompanying drawings.

DETAILED DESCRIPTION OF THE PREFERRED EMBODIMENT

This preferred embodiment is intended for use with a print head with hot melt ink. Hot melt ink is thermally treated to melt it for deposition, with it then becoming solid upon cooling. Other inks such as aqueous-based or oil-based inks can also be used. though small changes may be required to handle their constant liquid state.

Figure 1:
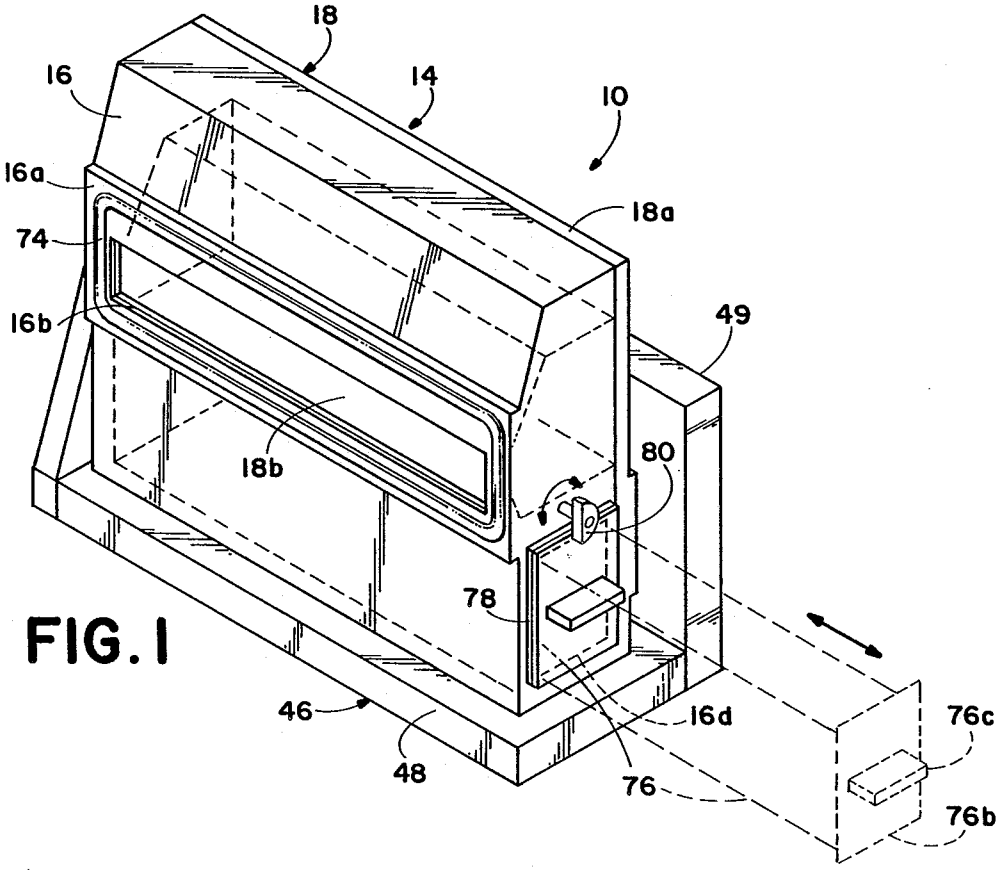
FIG. 1 is an isometric view of an ink jet head cleaning apparatus made according to the invention.
Figure 2:
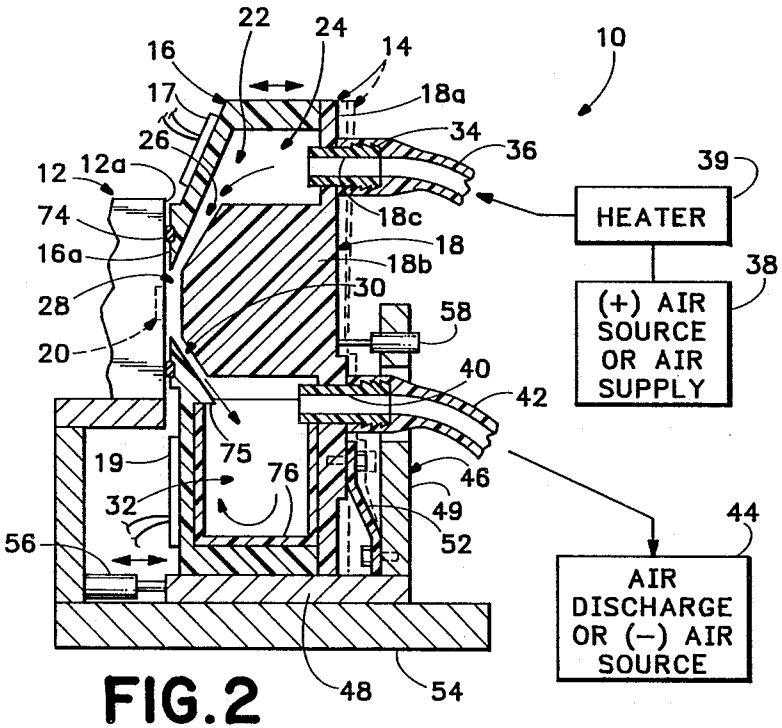
FIG. 2 is a cross-sectional view of the apparatus of FIG. 1 taken along line 2—2 of FIG. 1 mounted adjacent a print head.

Referring initially to FIGS. 1 and 2, an apparatus 10 is usable for cleaning a print head 12. Apparatus 10 includes a body 14 formed of a shell member 16 and a backing member 18. If a hot melt type of ink is used, these members are preferably made of a material that is rigid at the operating temperatures. Member 16 has what is referred to as a first planar face **16*a* in which is formed an opening 16*b*. This opening is sized to encompass the total vertical and horizontal dimensions of the array 20 of ink jet apertures of print head 12**.

A pair of heater elements 17 and 19 are preferably mounted on the exposed faces of member 16 associated with face **16*a*, as shown, or on backing member 18. Elements 17 and 19 are preferably a resistive serpentine heater within a Kapton TM tape sandwich, such as the commercially available MINCO TM foil heater. Such a heater assists in preventing significant cooling of the print head when it is in contact with body 14**. These heaters are only necessary if the print head is operated at temperatures substantially above room temperature.

Backing member 18 has a portion **18*a* that is attached to corresponding back edges of member 16. Member 18 also comprises an insert portion 18*b* which extends inside member 16. Member 16 and member 18, in combination, form a passageway 22 consisting of a distribution chamber 24, inlet channel 26, head-cleaning cavity 28, outlet channel 30, and ink-collection chamber 32**. The ends of the members are sealed so that there is no communication between sections of the passageway other than as described.

An inlet hole **18*c* passes through member 18, as shown, to receive a tube coupling element 34 to which is attached an inlet tube 36. As illustrated, and as will be explained, tube 36 may be connected to a supply 38 of air under positive pressure relative to the ambient pressure around body 14, or to what is referred to as an air supply, which may simply be the ambient air. Although air is specifically referred to, the supply may be any suitable fluid, such as nitrogen gas. It is also preferable that a filter be placed between air source 38 and inlet channel 26. Further, if appropriate, it is preferable that air source 38 include a heater 39, such as heater coils positioned in the air path, so that the air passing through cavity 28 and contacting print head 12** is maintained in a heated condition to avoid significantly cooling the print head.

Distribution chamber 24, inlet channel 26 and the fluid supply preferably provide a substantially even pressure and mass flow along the length of the inlet channel.

At the upper rear portion of chamber 32 is a corresponding tube coupling element 40 and outlet tube 42. This tube is coupled to discharge unit 44 that may simply be a discharge into the atmosphere, when a positive pressure supply 38 is used, or may be a subatmospheric pressure source, such as a vacuum pump. When a pump 44 is used, it also preferably comprises a filter for removing fine particulate matter between the outlet and the pump.

Body 14 is attached to a cleaner platform 46 which comprises a floor member 48 on which the body rests, a backing member 49 to which the body is attached. The body is preferably attached to platform 46 by a resilient connection which allows the body to move angularly relative to the platform. In the embodiment shown, this is provided by a connecting copper plate 52 having opposite ends joined to member 49 and member 18, as shown. The copper plate acts like a spring and allows the body to pivot about the plate, which runs along the length of the body.

Platform 46 is mounted to a printer frame 54 relative to which the print head is positionable for cleaning, as is conventionally provided at one end of the travel of the print head relative to a printing zone. Platform 46, and body 14 are movable into cleaning position by appropriate drive means, such as an actuator 56 mounted between frame 54 and platform 48, and actuator 58 between platform 48 and body 14. Face **16*a* is brought against the face of the print head for cleaning by the use of the actuators and spring plate 52**.

Figure 3:
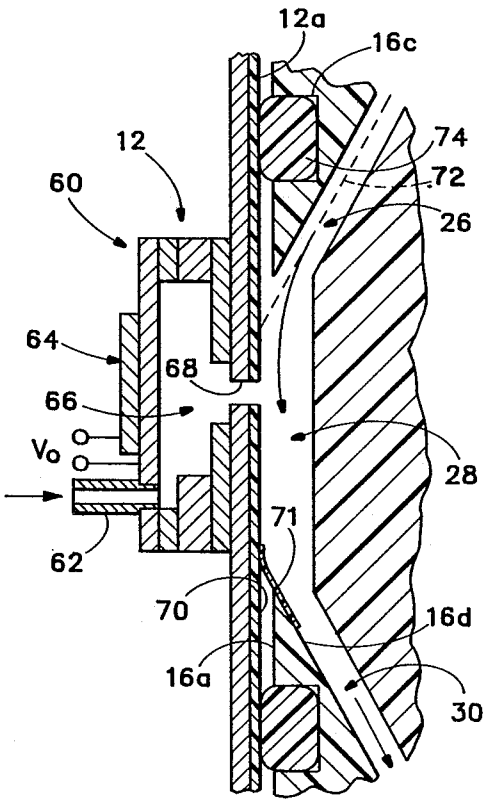
FIG. 3 is an enlarged cross-sectional view of an ink jet and a fragmented partial view of the apparatus of FIG. 1, not to scale.

An exemplary head 12 includes a print face **12*a*. Head 12 includes a plurality of ink jets 60 distributed in array 20 along print face 12*a*. Each ink jet 60, as shown in FIG. 3, comprises an ink inlet 62, a piezoelectric element 64 for ejecting the ink, an ink chamber 66, and an ink aperture 68 out through which the ink is ejected. The outer surface of face 12*a* adjacent the apertures is preferably coated with an anti-wetting material 70, such as the material sold under the proprietary name Teflon ® by DuPont Corporation. Layer 70 may be deposited to form the surface of face 12*a*** as described in copending application having Ser. No. 215,126 and entitled "Modified Ink Jet Printing Head Method for Producing Ink Jet Printed Images".

The space between faces **12*a* and 16*a* is preferably as narrow as is reasonably possible, without the faces touching. In order to help maintain continuous airflow and ink flow out of cavity 28, the space between these faces below aperture 68 is preferably closed. This may be accomplished by placing a length of Kapton TM tape 71 along the edge 16*d* forming one side of outlet channel 30 so that it contacts face 12*a*** during cleaning. Other compliant structures, such as a silicon rubber lip, could also be used.

As shown by dashed line 72, air is directed through inlet channel 26 into cavity 28 toward a point upstream, or in this case, above apertures 68. This assures that the gas will be flowing tangentially along face **12*a*** past the apertures.

Face **16*a* of member 16 has a continuous groove 16*c* extending around opening 16*b*. A resilient O-ring 74 is disposed in this groove. During operation, print head 12 is brought into position adjacent to cleaner 10. Cleaner 10 is then positioned by actuator 56 with the faces 16*a* and 12*a* flush. O-ring 74 contacts face 12*a* so that cavity 28 is sealed off from the ambient environment. The soft O-ring seal also prevents face 16*a* from damaging print head face 12*a* or coating 70 when apparatus 10 and print head 12 come in contact with each other. In the preferred mode of practicing the present invention as it applies to this embodiment, inlet tube 36 is coupled to an air source, such as filtered ambient air. Outlet tube 42** is coupled to a vacuum pump.

With the vacuum pump operating, air is drawn into cavity 28 at a transverse angle to face **12*a* by inlet channel 26. The air travels tangentially and continuously along face 12*a*, past apertures 68 and out outlet channel 30**. Any ink that has been deposited on the ink jet face outside of the apertures is carried down into the outlet channel. Thus, the face of the print head is thoroughly cleaned with a gas flow that is substantially and uniformly directed downwardly and away from the aperture. There are no impediments to the fiuid path that would cause eddies or separation regions, which in turn could result in failure to pick up and carry away some ink deposits.

The present apparatus can also be used with a positive air source attached to the inlet with substantially the same results. However, it has been found that the predominance of the subatmospheric pressure source, or vacuum pump, creates a stronger seal between faces 12*a* and 16*a*, which assures the integrity of passageway 20.

The ink that is picked up in cavity 28 by the passing fluid flow is deposited in outlet chamber 32. The outlet channel is directed downwardly into the chamber so that the ink drips into the chamber from a lip 75 or is thrown against the chamber walls. The air exiting the chamber then is substantially clear of entrained ink.

In order to facilitate cleanup of removed ink, a drawer 76 is placed through an opening 16*d* in the end of member 16. Drawer 76 rests on the bottom of chamber 32 and has sides that conform with the sides of chamber 32. The exposed face 76*a* of the drawer has a handle 76*b*. A seal gasket 78 is placed around drawer 76 between extended edges of face 76*a* and the associated face of member 16 around opening 16*d*. A latch 80 is mounted to member 16 for securing drawer 76 in chamber 32. Latch 80 is turned to allow removal of the drawer.

Drawer 76 is preferably made of a flexible, heat resistent material, such as Teflon ®. When the ink settles in the bottom of the drawer, it solidifies if it has not already done so. When the drawer is removed and flexed, the solidified ink is broken into pieces and dislodged from the drawer, thus facilitating removal.

Cleaner 10 thus provides an effective method and apparatus for providing controlled fluid flow for removing residue ink from the face of an ink jet print head. Variations in the form and structure of the cleaner, and in the steps providing cleaning can be made without parting from the spirit and scope of the invention as defined by the claims.

We claim:

1. An apparatus for cleaning an aperture of an ink jet print head, which aperture is disposed in a face of the print head, comprising:

a supply of cleaning fluid;

a body coupled to said cleaning fluid supply and having a first face configured for placement against the print head face, said first face having an opening sized to surround the print head aperture when said first face is placed against the print head face, said body including a cavity extending along said opening, an inlet opening into and forming, substantially, a first side of said cavity adjacent to one edge of said opening and configured to direct the cleaning fluid into said cavity toward a position on the print head face upstream from the aperture, and an outlet opening into and forming, substantially, a second side of said cavity adjacent to a generally oppositely disposed edge of said opening, said cavity forming a substantially uniform and uninterrupted passageway from said inlet, along said opening of said first face, to said outlet, said passageway in said cavity having cross-sectional dimensions substantially the same as the dimensions of said inlet;

means for moving said body so that said first face is placed against the print head face; and means for directing the cleaning fluid through said inlet into said cavity, along said opening of said first face, and out said outlet.

2. An apparatus for cleaning hot-melt ink from the apertures of an ink jet print head, which apertures are disposed in a face of the print head, comprising:

a frame;

a rigid body mounted for pivoting on said frame and having a first face placeable against the print head face, said first face having an opening sized to surround the apertures when said first face is placed against the print head face, said body defining a cavity extending along said opening, an inlet opening to said cavity adjacent to one edge of said opening, and an outlet opening into said cavity adjacent to a generally oppositely disposed edge of said opening;

means for moving said body so that said first face is placed against the print head face, with said body pivoting on said frame for aligning said first face with the print head face;

a gas supply coupled to said inlet;

means for applying a subatmospheric pressure to said outlet for drawing gas from said gas supply through said inlet, along the opening in said cavity, and out said outlet, and for drawing air leaking between the print head face and said first face into said cavity, when said first face is placed against the print head face;

means for forming an enclosed cavity by sealing said first face against the print head face with the apertures exposed to said opening;

means fixedly attached to said body for heating the portion of said body adjacent to the print head face during cleaning so that the print head is not cooled when said first face is placed against the print head face; and means coupled to the gas supply for heating the gas prior to being drawn through said cavity, so that the gas remains heated while flowing through said cavity and ink in contact with the gas remains in a liquid state.

3. An apparatus according to claim 2 wherein said body further defines a reservoir coupled to and below said outlet for collecting ink removed from the print head face by the heater fluid.

* * * * *